US009579720B2

(12) United States Patent
Ha

(10) Patent No.: US 9,579,720 B2
(45) Date of Patent: Feb. 28, 2017

(54) INJECTION MOLD FOR ROTARY-TYPE GRAVITY CASTING AND GRAVITY CASTING METHOD USING THE SAME

(71) Applicant: Hyundai Motor Company, Seoul (KR)

(72) Inventor: Seok Ha, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/624,224

(22) Filed: Feb. 17, 2015

(65) Prior Publication Data

US 2016/0107228 A1 Apr. 21, 2016

(30) Foreign Application Priority Data

Oct. 17, 2014 (KR) ..... 10-2014-0141016

(51) Int. Cl.
*B22D 27/08* (2006.01)
*B22D 23/00* (2006.01)
*B22D 43/00* (2006.01)

(52) U.S. Cl.
CPC ..... *B22D 27/08* (2013.01); *B22D 23/006* (2013.01); *B22D 43/00* (2013.01)

(58) Field of Classification Search
CPC ..... B22C 9/08; B22C 9/086; B22D 23/006; B22D 33/02; B22D 41/00; B22D 41/04; B22D 41/05; B22D 41/06; B22D 43/00–43/004; B22D 27/08
See application file for complete search history.

(56) References Cited

U.S. PATENT DOCUMENTS

| | | | | |
|---|---|---|---|---|
| 1,146,573 A * | 7/1915 | Jacobs | ..... | B22D 43/002 210/514 |
| 3,435,883 A * | 4/1969 | Fromson | ..... | B22D 23/006 164/136 |
| 8,141,616 B2 * | 3/2012 | Iwasa | ..... | B22D 23/006 164/136 |
| 2002/0000304 A1 * | 1/2002 | Kahn | ..... | B22D 23/006 164/136 |

FOREIGN PATENT DOCUMENTS

| | | | | |
|---|---|---|---|---|
| JP | 2010-131648 A | 6/2010 | | |
| KR | 10-0737004 B1 | 7/2007 | | |
| KR | 10-2013-0012460 A | 2/2013 | | |
| KR | 10-2014-0006400 A | 1/2014 | | |
| KR | 10-1414590 B1 | 7/2014 | | |
| WO | WO 2015082489 A1 * | 6/2015 | ..... | B22D 23/006 |

OTHER PUBLICATIONS

Machine Translation of KR 10-0737004 B1 (Jul. 2, 2007).*

* cited by examiner

*Primary Examiner* — Kevin E Yoon
*Assistant Examiner* — Jacky Yuen
(74) *Attorney, Agent, or Firm* — Mintz Levin Cohn Ferris Glovsky and Popeo, P.C.; Peter F. Corless

(57) ABSTRACT

An injection mold for rotary-type gravity casting and a gravity casting method using the same are provided. The injection mold includes a molten metal-supply chamber that is selectively coupled to a die. The molten metal-supply chamber is also configured to, during gravity casting along with rotation, supply a pure molten metal into the die while collecting impurities contained in the molten metal and preventing the ingress of the impurities into the die.

4 Claims, 4 Drawing Sheets

INJECTION MOLD FOR ROTARY-TYPE GRAVITY CASTING AND GRAVITY CASTING METHOD USING THE SAME

CROSS REFERENCE TO RELATED APPLICATION

The present application claims priority to Korean Patent Application No. 10-2014-0141016, filed Oct. 17, 2014, the entire contents of which is incorporated herein for all purposes by this reference.

BACKGROUND

Field of the Invention

The present invention relates, in general, to an injection mold for rotary-type gravity casting and a gravity casting method using the same and, more particularly, to an injection mold for rotary-type gravity casting which prevents the ingress of impurities into the mold during the gravity casting accompanied by rotation, and a gravity casting method using the same.

Description of the Related Art

Generally, gravity castings are casting processes that fabricate castings, such as pistons, sleeves, crankcases, cylinder heads or the like, by pouring a molten material, such as nonferrous alloy including aluminum (Al), magnesium (Mg), copper (Cu) or the like, cast iron, or steel, into a mold using gravity. Currently, when a cylinder head for a diesel engine is manufactured using the gravity casting, a riser is used to store molten metal used to compensate for the shrinkage of the casting, thereby providing a high quality of product.

Particularly, the riser provides the casting with a final solidified part to allow the casting defects and impurities to be collected therein, as well as to provide latent heat required for the casting to be uniformly unidirectionally solidified. A molten metal recovery ratio can be expressed by a ratio of product weight to total amounts of molten metal injected, and thus research and development of the technology for improving the quality of the casting while reducing the size and number of risers has been actively performed.

However, in the manufacture of a conventional cylinder head, as shown in FIG. 1, risers occupy about 50% of the total volume of molten metal injected, thus causing the recovery ratio to be a mere 50%. Further, rectangular injection molds are used to introduce molten metal into the mold along with impurities, degrading the quality of the casting.

The foregoing is intended merely to aid in the understanding of the background of the present invention, and is not intended to mean that the present invention falls within the purview of the related art that is already known to those skilled in the art.

SUMMARY

Accordingly, the present invention provides an injection mold for rotary-type gravity casting which prevents the ingress of impurities into the mold to improve the quality of a product while reducing amounts of molten metal in risers to reduce material cost, and a gravity casting method using the same.

According to one aspect, the present invention provides an injection mold for rotary-type gravity casting that may include: a molten metal-supply chamber selectively coupled to a die and configured to, during gravity casting along with rotation, supply a pure molten metal into the die while collecting impurities contained in the molten metal and preventing the ingress of the impurities into the die.

The injection mold may further include a molten metal-storage chamber that communicates with the molten metal-supply chamber; a housing that has an internal space defined therein; and a dividing wall that divides the internal space into the molten metal-storage chamber and the molten metal-supply chamber. An upper side of the dividing wall is coupled to an inner surface of an upper portion of the housing, and a lower side of the dividing wall is spaced at a particular distance from an inner surface of a lower portion of the housing.

The molten metal-storage chamber may have a cubic shape, and the molten metal-supply chamber may have a half-trapezoidal cross section. The inner surface of the housing may be coated with ceramic. The particular distance between the lower side of the dividing wall and the inner surface of the lower portion of the housing may range between about 20 mm and 50 mm, and the dividing wall may be positioned at a position that corresponds to ½ to ¾ of a longitudinal length from one side of the housing. The molten metal-supply chamber may have an internal angle, i.e., an angle between an inclined plane and a base plane, ranging between about 50 degrees and 80 degrees.

In another aspect, the present invention provides a gravity casting method using an injection mold for rotary-type gravity casting. The method may include: displacing a die such that an injection port of the die faces the ground (e.g., downward); supplying a molten metal into the injection mold having a molten metal-supply chamber configured to supply a pure molten metal into the die while collecting impurities contained in the molten metal and preventing the ingress of the impurities into the die; moving the injection mold to pressure-fit with the die; and rotating the pressure-fitted injection mold and the die.

The injection mold may include: a housing that has an internal space defined therein; and a dividing wall that divides the internal space into a molten metal-storage chamber and the molten metal-supply chamber. An upper side of the dividing wall is coupled to an inner surface of an upper portion of the housing, and a lower side of the dividing wall is spaced at a particular distance from an inner surface of a lower portion of the housing. In addition, the molten metal-storage chamber has a cubic shape, and the molten metal-supply chamber has a half-trapezoidal cross section.

The particular distance between the lower side of the dividing wall and the inner surface of the lower portion of the housing may range between about 20 mm and 50 mm, wherein the dividing wall may be positioned at a position that corresponds to ½ to ¾ of a longitudinal length from one side of the housing, and wherein the molten metal-supply chamber may have an internal angle ranging between about 50 degrees and 80 degrees.

According to the technical configuration of the present invention, the injection mold for rotary-type gravity casting may prevent the ingress of impurities into the mold to improve the quality of a product while reducing amounts of molten metal in risers to reduce on material cost.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinbelow, exemplary embodiments of the present invention will be described in detail with reference to the accompanying drawings.

Figure 1:
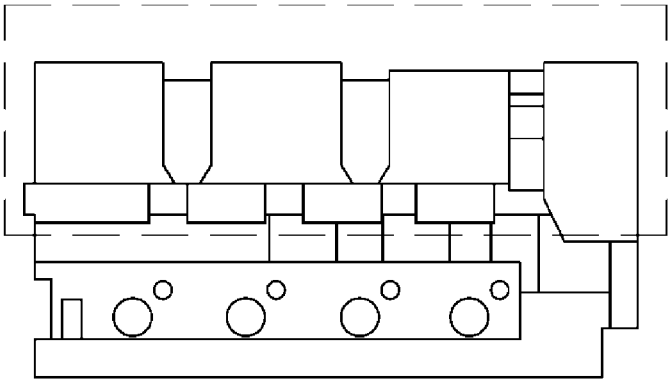
FIG. 1 (Related Art)
FIG. 1 is an exemplary view of a cylinder head having risers according to the related art.
Figure 2:
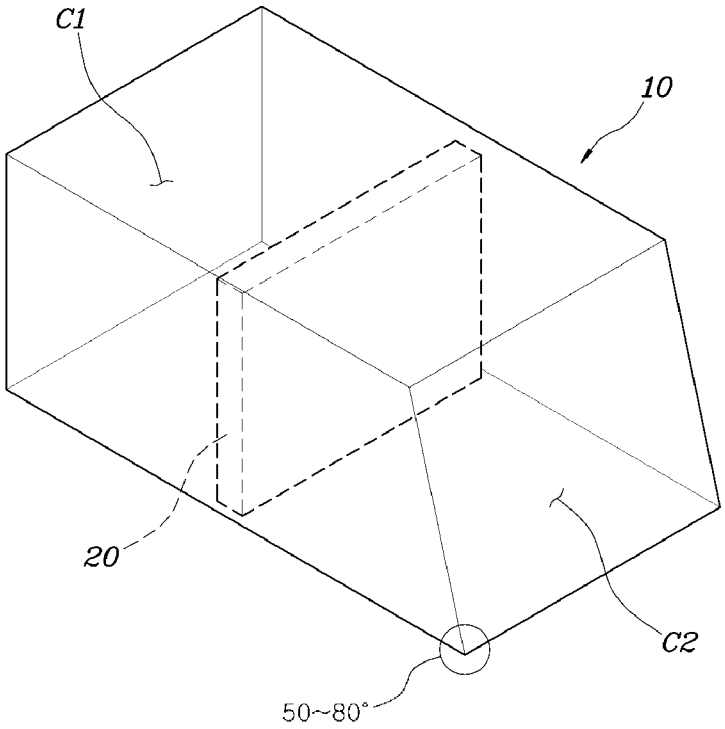
FIG. 2 is an exemplary view of an injection mold for rotary-type gravity casting according to an exemplary embodiment of the present invention.
Figure 3:
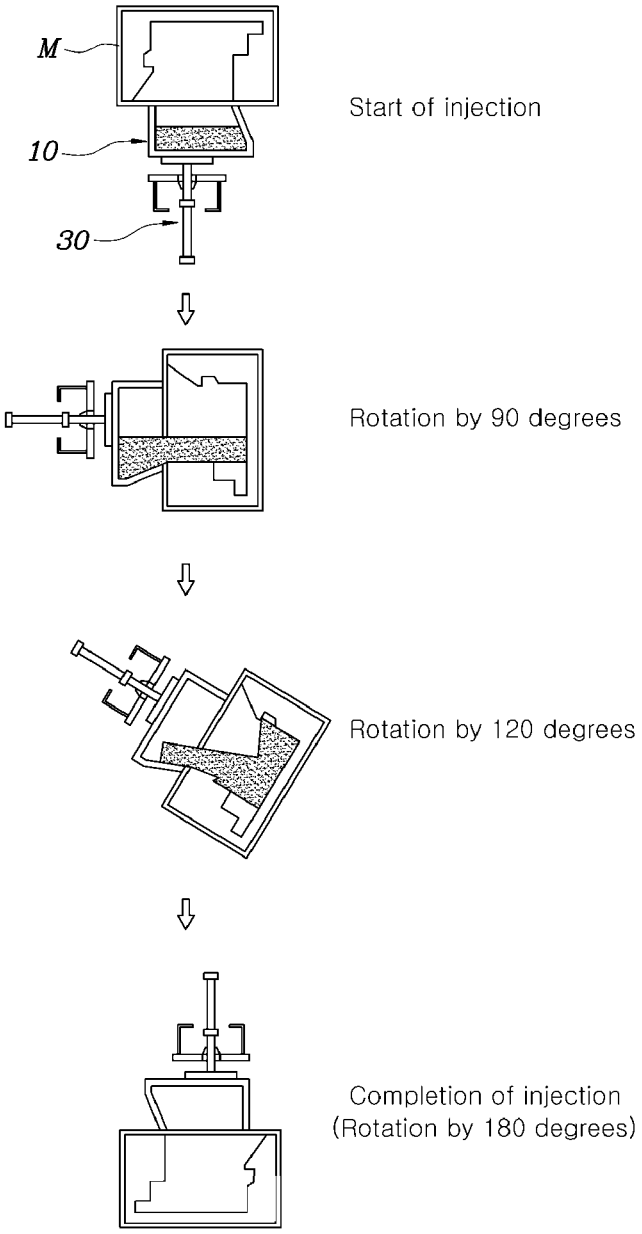
FIG. 3 is an exemplary view showing stages of performing gravity casting using the injection mold according to an exemplary embodiment of the present invention.

As shown in FIGS. 2 and 3, an injection mold for rotary-type gravity casting may include a molten metal-supply chamber C2 selectively coupled to a die M and configured to, during gravity casting along with rotation, supply a pure molten metal into the die M while collecting impurities contained in the molten metal and preventing the ingress of the impurities into the die M. The molten metal-supply chamber C2 has a space in which impurities contained in the molten metal may be collected during the gravity casting along with the rotation, and may be configured to collect the impurities, which fall down in the molten metal due to centrifugal force occurring upon the rotation of the molten metal-supply chamber C2, and then float on the molten metal when the molten metal is fully supplied into the die M.

The injection mold may further include a molten metal-storage chamber C1 which communicates with the molten metal-supply chamber C2. The molten metal-storage chamber C1 and the molten metal-supply chamber C2 may be integrally formed into a housing 10 having an internal space defined therein. The internal space may be divided by a dividing wall 20 into two sub-spaces that form the molten metal-storage chamber C1 and the molten metal-supply chamber C2, respectively. Additionally, an upper side of the dividing wall 20 may be coupled to an inner surface of an upper portion of the housing 10, and a lower side of the dividing wall 20 may be spaced at a particular distance from an inner surface of a lower portion of the housing.

The molten metal-storage chamber C1 may have a cubic shape, and the molten metal-supply chamber C2 may have a half-trapezoidal cross section. The particular distance between the lower side of the dividing wall 20 and the inner surface of the lower portion of the housing 10 may range between about 20 mm and 50 mm, and the dividing wall 20 may be positioned at a position that corresponds to ½ to ¾ of a longitudinal length from one side of the housing 10. The molten metal-supply chamber C2 may have an internal angle ranging between about 50 degrees and 80 degrees. When the dividing wall 20 is installed at a position before ½ of the longitudinal length from one side of the housing 10, the molten metal swirls, resulting in a degraded product. Also, when the dividing wall 20 is installed at a position after ¾ of the longitudinal length from one side of the housing, one sub-space of the internal space of the housing is reduced. Therefore, the dividing wall 20 may be installed at the position defined as described above.

The particular distance between the lower side of the dividing wall 20 and the inner surface of the lower portion of the housing 10 may range between about 20 mm and 50 mm. When the particular distance is 20 mm or less, fluidity of molten metal deteriorates, and when the specified distance is greater than 50 mm, there is no effect of removal of impurities (e.g., the impurities are not sufficiently removed). Further, when the internal angle of the molten metal-supply chamber C2 is less than 50 degrees, an injection angle of the molten metal is too small (e.g., insufficient), thus degrading the fluidity of molten metal, and when the angle is greater than 80 degrees, the effect of collecting impurities is reduced. In the meantime, the inner surface of the housing 10 may be coated with ceramic to maintain temperature of molten metal injected into the housing during rotary-type gravity casting.

Further, the present invention provides a gravity casting method using an injection mold for rotary-type gravity casting. The gravity casting method will be described with reference to FIG. 3. As shown in FIG. 3, the gravity casting method may include displacing a die M to cause an injection port of the die to face the ground, supplying a molten metal into the injection mold having a molten metal-supply chamber C2 configured to supply a pure molten metal into the die M while collecting impurities contained in the molten metal and preventing the ingress of the impurities into the die M, moving the injection mold to press-fit with the die M, and rotating the pressure-fitted injection mold and the die M.

More specifically, after molten metal is injected into the injection mold detached from the die M, the injection mold may be moved towards and be coupled to the die M with the injection port of the die disposed to face the ground. The coupled injection mold and the die may be rotated by about 90 degrees while the injection mold and the die may be hermetically sealed using a vertically-actuated drive unit 30, to allow a portion of molten metal to remain in the mold M and the other of the molten metal to remain in the injection mold.

In particular, upon the rotation, impurities contained in the molten metal fall down in the molten metal due to the centrifugal force, and in this state, when the injection mold and the die M are rotated by about 120 degrees, impurities may float on the molten metal due to a difference in specific gravities. Thus, when the molten metal is fully injected into the die M, impurities may remain in the injection mold outside of the die M. In other words, when the injection mold and the die M are rotated by about 90 degrees, the trapezoidal injection mold may operate as a trapping space to trap impurities therein, and when the injection mold and the die M are rotated by about 180 degrees, impurities may float on the molten metal due to the difference in the specific gravities, to prevent the injection mold and the die M from being introduced into the die M.

Figure 4:
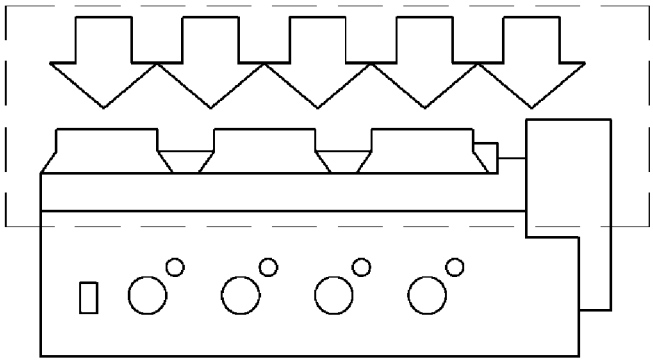
FIG. 4 is an exemplary view of a cylinder head having risers according to an exemplary embodiment the present invention.

As shown in FIG. 4, according to the injection mold for rotary-type gravity casting and the gravity casting method using the same, when gravity-casting a cylinder head, the amount of molten metal in risers and the number and size of the risers may be reduced, thereby obtaining about a 75% molten-metal recovery ratio and preventing the ingress of impurities into the die M and thus improving the quality of a product.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An injection mold for rotary-type gravity casting, comprising:

a molten metal-supply chamber selectively coupled to a die and configured to, during gravity casting along with rotation, supply a pure molten metal into the die while collecting impurities contained in the molten metal and preventing the ingress of the impurities into the die;

a molten metal-storage chamber that communicates with the molten metal-supply chamber;

a housing having an internal space defined therein; and a dividing wall that divides the internal space into the molten metal-storage chamber and the molten metal-supply chamber, wherein an upper side of the dividing wall is coupled to an inner surface of an upper portion of the housing, wherein a lower side of the dividing wall is spaced at a particular distance from an inner surface of a lower portion of the housing, and wherein the molten metal-storage chamber has a cubic shape, and the molten metal-supply chamber has a half-trapezoidal cross section and the injection mold is connected to a topside of the half-trapezoidal cross section of the molten metal-supply chamber.

2. The injection mold according to claim 1, wherein the inner surface of the housing is coated with ceramic.

3. The injection mold according to claim 1, wherein the particular distance between the lower side of the dividing wall and the inner surface of the lower portion of the housing ranges between about 20 mm and 50 mm, and the dividing wall is positioned at a position that corresponds to ½ to ¾ of a longitudinal length from one side of the housing.

4. The injection mold according to claim 1, wherein the molten metal-supply chamber has an internal angle between an inclined plane and a base plane that ranges between about 50 degrees and 80 degrees.

* * * * *